United States Patent [19]

Habib

[11] Patent Number: 4,524,544

[45] Date of Patent: Jun. 25, 1985

[54] MACHINE FOR BACKING-OFF AND/OR GRINDING DRIFTING SPINDLES PROVIDED WITH TEETH

[76] Inventor: Robert Habib, 36, Quai Gustave Adord, 1207 Geneva, Switzerland

[21] Appl. No.: 465,256

[22] Filed: Feb. 9, 1983

[30] Foreign Application Priority Data

Mar. 5, 1982 [CH] Switzerland ..... 1351/82

[51] Int. Cl.[3] ..... B24B 3/22

[52] U.S. Cl. ..... 51/92 R; 51/34 C; 51/92 ND; 51/45; 51/288

[58] Field of Search ..... 51/34 C–34 J, 51/35, 36, 92 R, 92 BS, 92 ND, 92 HK, 93, 288, 44, 45

[56] References Cited

U.S. PATENT DOCUMENTS 1,545,111 7/1925 Wilder ..... 51/35

2,949,706 8/1960 Brady ..... 51/34 C 4,272,927 6/1981 Myers et al. ..... 51/288 X 4,348,838 9/1982 Tacchella ..... 51/92 R X

FOREIGN PATENT DOCUMENTS 370753 4/1939 Italy ..... 51/92 R

*Primary Examiner*—Robert P. Olszewski

*Attorney, Agent, or Firm*—Birch, Stewart, Kolasch & Birch

[57] ABSTRACT

The machine comprises a sliding table (4) and a support (5,6) mounted on a transverse slide (1). The grinding spindle (7) is mounted on the support (5,6) by way of slide (14) which can be oriented by the slide (14) whereof the sliding plane of the slide is vertical and parallel to the axis of the grinding spindle (7) and whereof the sliding direction can be oriented in several positions. The grinding spindle (7) can also be oriented about an axis perpendicular to the slide (14).

1 Claim, 4 Drawing Figures

MACHINE FOR BACKING-OFF AND/OR GRINDING DRIFTING SPINDLES PROVIDED WITH TEETH

BACKGROUND OF THE INVENTION

The present invention relates to a machine for backing-off and/or grinding drifting spindles provided with teeth, essentially spindles of any type, namely of round, flat or helical shape, the machine comprising a sliding table and a grinding spindle mounted on a support which can be oriented and moved transversely with respect to the table.

During the backing-off or grinding of a spindle on machines of this type, the spindle is fixed on the sliding table, whereas the grinding wheel, inclined in the desired position, is advanced either transversely or vertically with respect to the spindle in order to carry out the backing-off or grinding operation and moves away in the same manner. However, for certain types of spindles, the operation is more complicated. In fact, at the time of plunging grinding, for example, of a round spindle by a conical grinding wheel, the grinding wheel cannot be advanced transversely in order to grind the circular teeth of the spindle, since there is a danger of grinding part of the circular periphery of the respective teeth. Normally, for grinding a round spindle the grinding wheel is lowered vertically, by lowering the column which supports it, into the space between teeth and the spindle is advanced until the face to be ground comes into contact with the grinding wheel. The operations are reversed after grinding.

These operations involve a considerable waste of time on the one hand and on the other hand the space between two consecutive teeth must be sufficiently large in order that the grinding wheel can be lowered to the grinding height and wait for the arrival of the tooth to be ground without touching the backing-off of the preceding tooth. The mass to be moved is also considerable and contrary to the laws of ergonomics.

SUMMARY OF THE INVENTION

The present invention makes it possible to remedy these drawbacks by enabling the grinding spindle and more precisely the grinding wheel to descend not vertically, but obliquely, parallel to the tooth in order to grind or back-off the tooth and to release the tooth in the same direction without any danger of touching the preceding tooth or the edge of the tooth with which the grinding wheel was engaged.

The machine, according to the present invention, is characterised by the fact that the support for the grinding spindle includes a slide the sliding plane thereof being vertical and parallel to the axis of the grinding spindle and whereof the sliding direction can be oriented in several positions in said plane.

By orienting the grinding spindle in order that the working face of the grinding wheel occupies the angular position of the tooth, the sliding direction of the slide is adjusted so that the grinding wheel plunges between two teeth and grinds the face of the tooth. After grinding, the grinding wheel releases the tooth in the opposite direction. One thus achieves a considerable saving of time and grinding or backing-off is facilitated. The sliding direction may vary by 360° and with the possibility of the grinding spindle pivoting through 360° about a horizontal axis, any cutting or grinding angle can be achieved with a single operation, whatever the orientation of the left-hand or right-hand teeth might be with respect to the operator and whatever the cutting angle of the teeth of the spindle or wheel.

BRIEF DESCRIPTION OF THE DRAWINGS

The accompanying drawings illustrate, by way of example, one embodiment of the invention.

DETAILED DESCRIPTION

Figure 1:
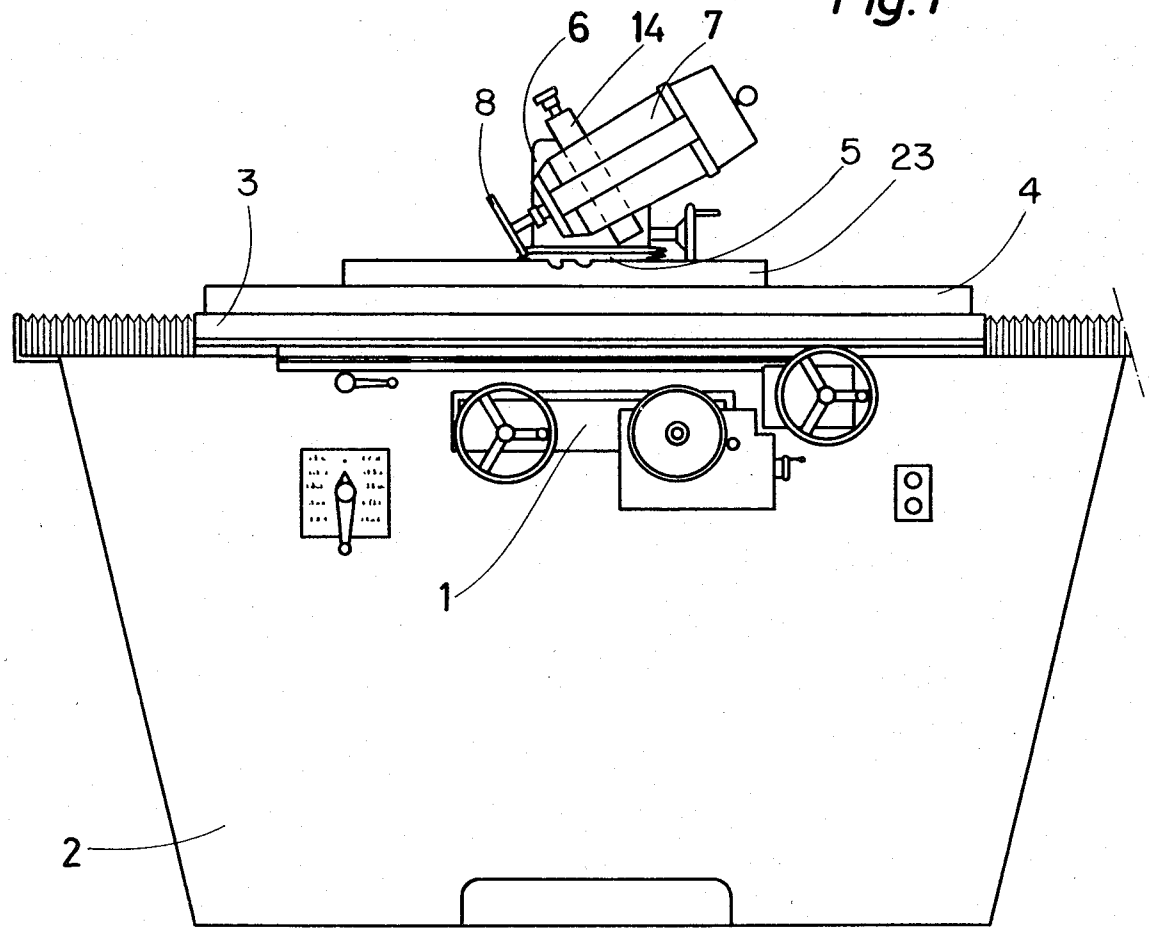
FIG. 1 is a general, elevational view of the machine.
Figure 2:
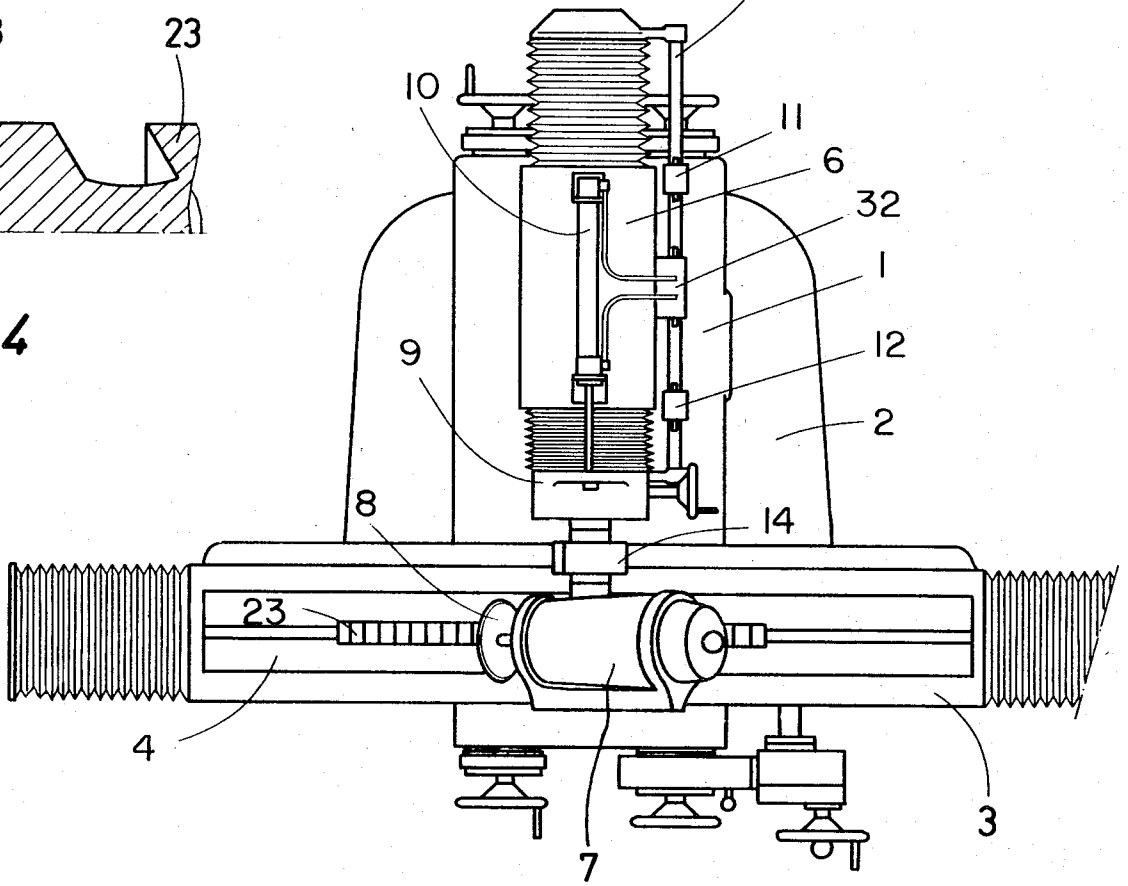
FIG. 2 is a plane view.

The machine illustrated in FIGS. 1 and 2 is basically a known machine as regards the essential components, with the exception of the device which is the subject of the present invention, it is sold under the registered trade mark "HARO".

The machine comprises a transverse slide 1, passing through the frame 2 below the longitudinal slide 3 on which a table 4 is fixed. The transverse slide 1 supports a vertical column 5 on which a body 6 is fixed, which supports a slide 9 on which the pivoting slide 14 is fixed. Fixed to the slide 14 is a pivoting grinding spindle 7 provided with a motor intended to drive a grinding wheel 8. The grinding spindle may thus carry out a reciprocating motion transversely with respect to the table 4, in a perpendicular or oblique direction, if the body 6 is pivoted about the column. The reciprocating motion is controlled by a double-acting jack 10 controlled by two adjustable end-of-travel stops 11,12 supported by a lateral bar 13 connected to move with the grinding spindle 7 and acting on the valve 32. Several wheels are provided for the manual adjustment and entrainment of the various movable parts. The body 6 may also move vertically with the column 5.

The possibilities of movement of the grinding spindle 7 were hitherto limited to a transverse movement with respect to the table 4 and/or a vertical movement. In addition to these movements which still remain possible, the pivoting slide 14 makes it possible to move the grinding spindle 7 in an oblique direction parallel to a vertical plane and thus to plunge with the grinding wheel below the inclined face (cutting angle) of the tooth in order to grind it and release the tooth after grinding or backing-off without any danger of grinding the preceding tooth or the periphery of the ground tooth.

Figure 3:
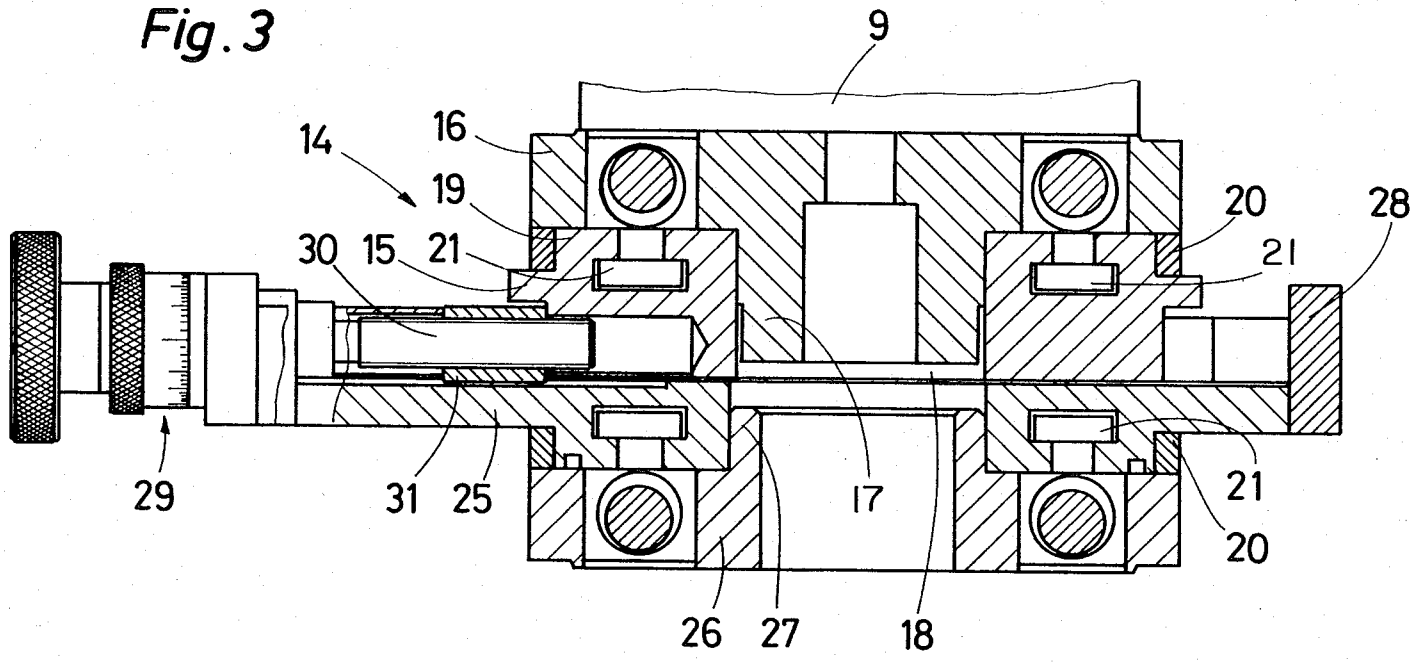
FIG. 3 is a partial longitudinal sectional view of the slide.

The slide 14 shown in side view and in section in FIG. 3 is mounted by a fixed part 15 on a drum 16, in turn fixed to the slide 9. The drum 16 comprises a journal 17 cooperating with a bore 18 in the part 15 of the slide. The upper face of the part 15 terminates in a ring shape 19 around which a graduated ring 20 is fixed. Two tie-rods 21 controlled by eccentrics make it possible to lock the part 15 in the chosen angular position. Fixed in a similar manner to the movable part 25 of the slide is a drum 26 comprising a journal 27, the drum 26 supporting the grinding spindle. The two tie-rods 21 comprising eccentrics also make it possible to lock the drum 26 in the desired angular position. The part 28 is the support for the end of the rod of a jack (not shown) controlling the slide. A micrometric device 29 controls a screw 30 cooperating with a nut 31 serving as an end of a travel stop for the movable part 25 of the slide, thus making it possible to regulate the depth of cut with great accuracy. By loosening the tie-rods 21 from the fixed part 15, the slide is rotated by referring to the graduated ring 20 as far as the desired sliding direction and the tie-rods are retightened. The same operation is then recommenced with the drum 26 supporting the grinding spindle.

It is obvious that the slide may be controlled by a stepping motor or any other known means.

Figure 4:
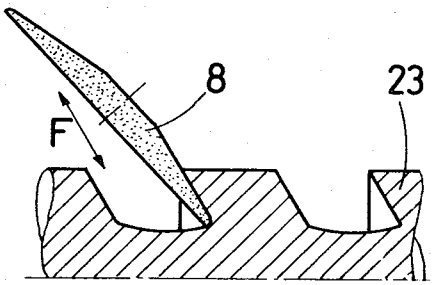
FIG. 4 illustrates grinding of the cutting angle of a tooth to be ground.

FIG. 4 shows a round spindle 23 ground by a conical grinding wheel 8. By moving the grinding spindle in the direction of arrow F, one plunges into the surface to be ground in a single operation and the tooth is released by moving in the opposite direction.

It is obvious that the same slide 14 also makes operations for grinding the backing-off of the tooth easier.

In general, the device of the invention allows grinding of spindles of all types, namely of flat, round or helical shape and the creation of cutting-braking grooves by jumping, for example, every other tooth.

The fact that it is possible to combine the orientation of the body 6 about the column 5 and to move it vertically, with the orientation of the slide 14 and that of the grinding spindle 7 about a horizontal axis, makes it possible to grind or back-off cutting tools virtually at any angle, while simplifying the operations.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A machine for backing-off and grinding drifting spindles provided with teeth comprising a sliding table and a grinding spindle and associated conical grinding wheel mounted on a support on said table, with said support being oriented and movable transversely with respect to said table, mounting of said grinding spindle to said support including a pivotable slide having a sliding plane vertical and parallel to said grinding spindle's axis with a sliding direction being oriented in said plane, said slide having a fixed part and a movable part, said fixed part comprising a cylindrical bore perpendicular to said sliding plane and cooperating with a first journal of a first drum integral with said support of said grinding spindle which allows positioning of said slide in a desired sliding direction by rotation about said journal and further providing a locking means for locking said slide in a desired angular position, said grinding spindle being further supported by a second drum fixed to said movable part of said slide, said second drum having an axis perpendicular to said spindle and comprising a second journal cooperating with a bore in said movable part of said slide in order to allow angular positioning of said grinding spindle with respect to said sliding table in a plane parallel to the sliding plane of said slide, by rotation of said second journal in said bore of said movable part of the slide, said locking means also provided for locking said second drum in a desired angular position.

* * * * *